United States Patent [19]

Krisztics

[11] Patent Number: 4,909,208

[45] Date of Patent: Mar. 20, 1990

[54] ROTARY INTERNAL COMBUSTION MOTOR

[76] Inventor: Attila Krisztics, Mogyoród utja 37, 1151 Budapest, Hungary

[21] Appl. No.: 267,660

[22] Filed: Nov. 3, 1988

Related U.S. Application Data

[63] Continuation-in-part of Ser. No. 62,474, Jun. 12, 1987, abandoned.

[30] Foreign Application Priority Data

Jun. 20, 1986 [HU] Hungary ..... 2589/86

[51] Int. Cl.[4] ..... F02B 53/00

[52] U.S. Cl. ..... 123/222; 123/239

[58] Field of Search ..... 60/39.6; 123/68, 222, 123/228, 236, 239; 468/13

[56] References Cited

U.S. PATENT DOCUMENTS

| | | | |
|---|---|---|---|
| 891,820 | 6/1908 | Cruyt | 60/39.6 X |
| 904,974 | 11/1908 | Lee | 123/239 |
| 1,228,806 | 6/1917 | Morris | 123/222 |
| 2,373,304 | 4/1945 | Garbeth | 123/222 |
| 3,215,129 | 11/1965 | Johnson | 123/236 X |
| 4,015,424 | 4/1977 | Shinohara | 123/228 X |

FOREIGN PATENT DOCUMENTS

| | | | |
|---|---|---|---|
| 103086 | 5/1899 | Fed. Rep. of Germany | 123/222 |
| 863856 | 1/1941 | France | 123/222 |

*Primary Examiner*—Michael Koczo

*Attorney, Agent, or Firm*—Schweitzer & Cornman

[57] ABSTRACT

An internal combustion motor consists of three rotary units, namely a pump (A) with blades, a bladed motor (C) and a combustion space (B) which is a cylindrical chamber (7) including a rotor (8) performing a rotary motion in a sealed manner, having at least one open cavity (9) on the mantle near to its edge. An inflow port (1) of the pump (A) communicates with the ambient atmosphere through an air filter (11). The outflow port (2) communicates with the inflow port (2') of the combustion space (B). The outflow port (4') of the combustion space (B) is connected to the inflow port (4) of the motor (C), while the outflow port (5) of the motor (C) is connected through the silencer (13) with the ambient air. Progressing from the inflow port (2') to the outflow port (4') in a sense of rotation in the wall of the chamber (7) an aperture (3) is formed for injecting fuel and/or an ignition plug (14) is fastened therein. The central angle between the nearest points of the combustion space (B), i.e. the inflow port (2') and the fuel injecting aperture (3) and/or the ignition plug (14) is larger than the central angle enclosing the aperture of the cavity (9) in the rotor. The ratio of the largest closed volume of the pump (A) and the cavity (9) corresponds to the compression ratio of the motor.

1 Claim, 1 Drawing Sheet

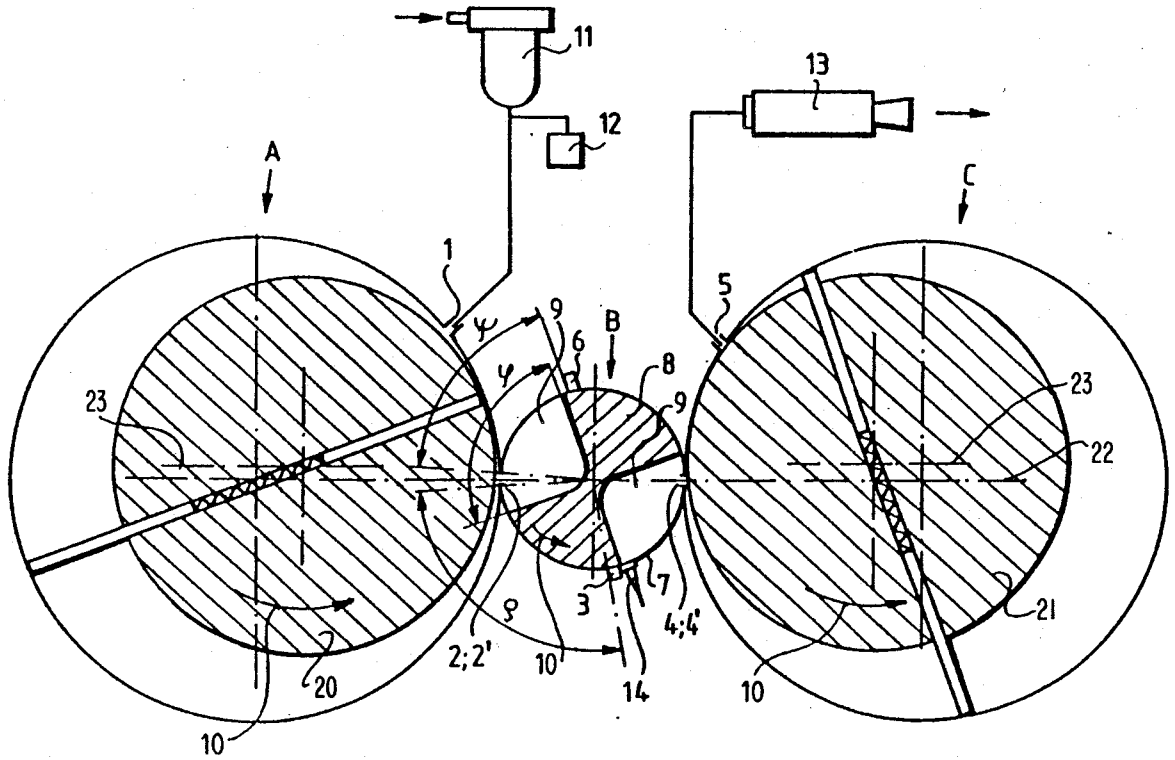
A
B
C
1
2;2'
3
4;4'
5
6
7
8
9
10
10'
11
12
13
14
20
21
22
23

ROTARY INTERNAL COMBUSTION MOTOR

This is a continuation-in-part of co-pending application Ser. No. 062,474, filed on June 12, 1987, abandoned.

The invention relates to an internal combustion motor which can be operated with gasoline, Diesel fuel or gas, that means with all the traditional fuels.

The endeavour is well known, in sense of which reciprocating engines ought to be replaced by rotation internal combustion motors. Rotation motors having been developed up to now, out of which Wankel-motors are the best known, could not be become general, as they are too complicated. Problems connected with sealing could not be solved at all, and if, with difficulties only. As it is well known, sealings must follow most complicated motion, additionally they are subjected to a considerable thermal effect.

The aim of the invention is to develop a rotation internal combustion engine with a simple design and which can be easily sealed.

The invention is based on the recognition, in so far as, if internal combustion motors are separated according to functional cycles, one has to provide for the sealing of simple rotary elements only, while the single sealings can be kept always at a constant temperature, accordingly, problems of sealing connected to thermal fluctuation can be eliminated. Otherwise, it is not necessary to separate all the cycles, it suffices to separate only three of them, namely to develop a suction-compression cycle, an explosive cycle and an expansion-exhaust cycle.

Accordingly, the internal combustion motor according to the invention is designed so, that it consists of three rotary units, namely of pump with blades known itself, the bladed motor and a unit forming the combustion space; the combustion space is a cylindrical chamber including a rotor performing a rotary motion in a sealed manner, having advantageously an open cavity on its mantle; inflow port of the pump is connected expediently with the ambient atmosphere, outflow port communicates with the inflow port of the combustion chamber and the outflow port of the combustion chamber is connected to the inflow port of the motor, while the outflow port of the motor is advantageously communicating with the environment through an exhaust manifold; when progressing to the outflow port in operative rotary sense, in the wall of the chamber there is an opening for injecting the fuel and/or an ignition plug; the central angle between the nearest points of the inflow port of the combustion chamber and the opening for injecting the fuel and/or the ignition plug is larger, than the central angle enclosing the opening of the cavity in the rotor, at last, the ratio of the cavity and the largest closed volume of the pump equals to the compression ratio of the internal combustion motors known in itself, depending on the fuel-tolerance.

With a preferred embodiment of the internal combustion motor according to the invention in a manner known in itself a carbureter is connected to the inflow port or the outflow port of the pump.

With another preferred embodiment of the internal combustion motor according to the invention the combustion chamber is provided with a port for introducing the fuel, which is arranged on the side of the inflow port facing the ignition plug, and at a central angle, which is at least so large, as the central angle between the inflow port and the outflow port and said opening for introducing the fuel is connected to a pipe delivering a combustible gas.

The invention will be described in detail by means of a preferred embodiment, by the aid of the drawing enclosed.

The FIGURE illustrates unambiguously the three main parts of the internal combustion motor according to the invention. The pump "A" with the blades and the motor "C" with the blades are designed in a traditional way in respect to fluid mechanics. It goes without saying, when choosing the materials to be used, one has to consider that dynamic and thermic load of the internal combustion motors differ from those of the usual pumps and mainly of the motors.

The part of the internal combustion motor which supplies the energy needed for burning the fuel, is arranged between the pump "A" and the motor "C", and this is the combustion chamber "B".

The unit "B" consists of a cylindrical chamber 7 and the rotor 8 rotating therein in a sealed manner. The rotor 8 is provided with at least one cavity 9 (the embodiment illustrated in the figure has two). The rotor 8 in the cylindrical chamber 7 is sealed so (with a sealing or high-accurate joint), that the cavities 9 do not communicate with each other or with any other spaces of the internal combustion motor, with the exception of connections to be detailed later.

Single parts are interconnected as follows:

Inflow port 1 of the pump "A" communicates with the environment via the air-filter 11, which can be of any type usually used with internal combustion motors.

Outflow port 2 of the pump "A" is connected to the inflow port 2' in the wall of the cylindrical chamber 7; with the embodiment shown here outflow port 2 and inflow port 2' are formed by one single bore crossing the common wall of the pump "A" and the cylindrical chamber 7. In a similar way, the outflow port 4' of the cylindrical chamber 7 communicates with the inflow port of the motor "C" through one single bore. At last, the outflow port 5 of the motor "C" discharges into the atmosphere via the exhaust manifold 13. The exhaust manifold 13 has the same function, as with the usual internal combustion motors (reduction of the emission of combustion products, sound absorption), so any type of exhaust manifold can be used for this purpose.

In dependence of the fuel used, fuel can be supplied to the internal combustion motor on different places.

For introducing the mixture of gasoline-combustion air and fuel with atmospheric pressure the carburetter 12 is built-in before the inflow port 1 of the pump "A". A mixture consisting of gasoline-combustion air and fuel under compression can be supplied so, that the carbureter is connected to the channel or bore between the outflow port 2 of the pump "A" and the inflow port 2' of the combustion space "B".

In case of gasoline injection the nozzle 3 is arranged in the wall of the cylindrical chamber 7 of the combustion space "B". In case of Diesel-operation the nozzle for Diesel-oil can be arranged in the same manner.

At last, the internal combustion engine according to the invention can be operated with gas, too. For this purpose the gas-nozzle 6 is arranged in the wall of the cylindrical chamber 7. With modes of operation, where ignition of the air-fuel mixture requires an electric spark, the ignition plug 14 extends into the wall of the cylindric chamber 7.

Between the relative position of the nozzle 3 resp. gas-nozzle 6 arranged in the wall of the cylindric chamber 7, and of the ignition plug 14 of the inflow port 2' and the size of the cavity 9 in the rotor 8 are staying in a close mutual relation. It is quite obvious, that burning of the fuel should be started after having interrupted the connection between the inflow port 2' and the cavity 9. This requirement is met by the following design:

Expediently the cavity in the rotor 8 is formed so that only the mantle surface of the rotor 8 should be open. It goes without saying that the opening of the cavity 9 could be formed on the frontal surface of the rotor 8, possibly nearest to the mantle surface, however, this is a most complicated solution. The farthest points of the cavity opening—viewed in the sense of rotation, as indicated with the arrow 10—enclose the central angle $\phi$, this central angle $\phi$ is to be chosen with a large angular aperture. The previously mentioned requirement can be met only, if the nearest points of the inflow port 2' and the nozzle 3 and/or the connecting port of the ignition plug 14—viewed in the direction of rotation, as indicated with the arrow 10—enclose a central angle $\phi$, which is larger, than the central angle $\phi$.

From all what has been said it becomes obvious—also in consideration of the principle of operation—that the angular aperture, i.e. the angle $\phi$ between the nearest points of the nozzle 6 and the inflow port 2'—seen in the direction of rotation as indicated with the arrow 10—must be also larger, than the central angle $\phi$.

The internal combustion motor according to the invention operates as follows:

Pump "A" sucks-in air through the air-filter 11 and in a given case fuel from the carbureter 12, entering through the inflow port 1. After a half rotation suction cycle is finished, compression begins. The blade of the pump "A" leaves the outflow port 2, simultaneously with compression air or a mixture of air and fuel is flowing through the outflow port 2 to the cavity 9 of the rotor 8 of the combustion space "B". Aperture of the cavity 9 and number of revolutions of the rotor should be chosen so, that air or the mixture of air and fuel could flow completely into the cavity 9. With the internal combustion motor as illustrated in the figure complete flow can be achieved so, that number of revolutions of the rotor 8 amounts to the double of the number of revolutions of the pump "A", while the $\phi$ central angle equals to about 90°. From this it becomes obvious that volume of the cavity 9 is to be chosen so, that pressure of the compressed air delivered by the pump should correspond to the compression-tolerance of the fuel chosen. So, if gasoline is used as fuel, ratio of the delivery volume of the pump "A" related to a half rotation and the volume of the cavity 9 may lie in the range between 7:1 and 10:1.

Fuel is injected to the air in the cavity 9 through the nozzle 3 and/or the mixture of air and fuel is ignited (by self-ignition in case of Diesel-operation). When the cavity arrives at the outflow port 4' of the combustion space "B", the gas with a pressure having been increased in course of combustion is flowing out through the inflow port 4 of the motor "C" and puts it into a rotary motion and after expansions it is discharged through the outflow port 5 and the silencer 13 into the open air. From the arrangement it becomes obvious that in this case the number of revolutions of the motor "C" equals to the half of the number of revolutions of the rotor 8.

In case, if it is intended to operated the internal combustion motor with gas, gas may be introduced into the cavity 9 by means of the nozzle 6. Nozzle 6 is arranged before the inflow port 2' and so, that the cavity 9 should not be able to interconnect them, as in such a manner after exhaust gas can be charged into the essentially emptied cavity 9 staying under atmospheric pressure.

In accordance with the invention, the respective "pump" and "motor" spaces A and C are of equal size, as are the respective rotors 20, 21 mounted therein. Furthermore, the respective chambers A and C are mounted in a common plane with the chamber of the combustion space B. In other words, the axes of all three of the chambers A, B, and C lie in the common plane 22. The respective pump and motor rotors 20, 21 are offset equidistantly and to the same side of the common plane 22. Thus, the axes of the rotors 20, 21 are located on a common plane 23, which is parallel to the plane 22.

The above described geometrical relationship of the chambers and rotors enables the apparatus of the invention to be operated in either direction. That is, the "pump" section A may be configured to function as the combustion chamber and the combustion chamber C may be configured to function as the pump, by reversing the direction of rotation of the rotors 20, 21, reversing the connections of the intake and exhaust equipment, and reconfiguration of the fuel injection and/or ignition elements, so that the combustion chamber B cooperates in its combustion phase with the chamber A.

It goes without saying that the internal combustion motor is to be provided with several fittings, so e.g. fuel supply system, self-starter, a transmission for synchronizing the number of revolution of the rotating parts etc., however, these are traditional fittings or units to be assembled from traditional elements, e.g. gears; understanding of the invention does not require the detailed specification thereof.

What we claim:

1. In a rotary internal combustion engine of the type having first, second and third cylinder chambers, each with a rotor member therein, the first such chamber and rotor functioning as a compressor for atmospheric air, the second such chamber and rotor functioning as a combustion chamber, and the third such chamber and rotor functioning as a motor and being driven by the combustion gases from said second chamber, the improvement characterized by (a) the axes of said first and second chambers defining a first plane and the axes of said second and third chambers defining a second plane coincident with said first plane, (b) said first and third rotors being offset from the respective first and second planes, and said second rotor having its axis on said first and second planes, (c) first and second discharge port means connecting, respectively, said first and second chambers and said second and third chambers and being located symmetrically on said first and second planes, (d) said second rotor having at least two spaced recesses for the reception of compressed gases from said first port means and for the discharge of gases undergoing combustion from said second port means, (e) a combustion initiating device in said second chamber adapted to be exposed to a recess of said second rotor during a predetermined rotary positioning of the latter, (f) said combustion initiating device being spaced from said first port means by a sufficient rotary angle that said recesses do not communicate simultaneously with said first port means and said combustion initiating device.

* * * * *